United States Patent [19]

Nishimura et al.

[11] Patent Number: 4,693,401

[45] Date of Patent: Sep. 15, 1987

[54] APPARATUS FOR COMPRESSIVELY HOLDING CASTING NOZZLES

[75] Inventors: Takahiro Nishimura; Masao Ohnuma, both of Kitakyushu, Japan

[73] Assignee: Kurosaki Refractories Co., Ltd., Kitakyushu, Japan

[21] Appl. No.: 759,638

[22] Filed: Jul. 26, 1985

[30] Foreign Application Priority Data

Jul. 28, 1984 [JP] Japan ..... 59-158285
Aug. 24, 1984 [JP] Japan ..... 59-177304

[51] Int. Cl.[4] ..... B22D 37/00

[52] U.S. Cl. ..... 222/607; 222/600; 222/512; 222/567; 198/576; 198/736

[58] Field of Search ..... 222/591, 594, 600, 606, 222/607, 512, 567; 164/437; 198/736, 737, 576

[56] References Cited

U.S. PATENT DOCUMENTS

| | | | |
|---|---|---|---|
| 2,999,579 | 9/1961 | Kostrzewa | 198/736 X |
| 3,352,465 | 11/1967 | Shapland | 222/600 |
| 3,907,022 | 9/1975 | Simons et al. | 164/437 X |
| 4,079,869 | 3/1978 | Meier et al. | 222/607 X |
| 4,220,271 | 9/1980 | Szadkowski | 222/607 |
| 4,415,103 | 11/1983 | Shapland et al. | 222/600 X |

*Primary Examiner*—Joseph J. Rolla

*Assistant Examiner*—Frederick R. Handren

*Attorney, Agent, or Firm*—Jordan and Hamburg

[57] ABSTRACT

An apparatus for changing casting nozzles such as immersion nozzles easily, quickly, and reliably. The apparatus has a holder frame fixed to the bottom of a molten metal pouring device and defining a substantially C-shaped casting nozzle travel passageway composed of a new-nozzle insertion passage, an old-nozzle ejection passage extending parallel thereto in spaced-apart relationship, and a joint passage connecting the new-nozzle insertion passage and the old-nozzle ejection passage to each other, and having a casting position where the casting nozzle is held under compression; a spring box mounted in the holder frame and having outer side portions resiliently supported by springs on opposite sides of the holder frame across the casting nozzle travel passageway, the spring box having on inner sides thereof guide rails forming part of side portions of the casting nozzle travel passageway, a nozzle moving mechanism mounted on the holder frame for moving the casting nozzle along the guide rails; and a lifting mechanism for lifting the casting nozzle in unison with the spring box in response to movement of the casting nozzle along the guide rails until the casting nozzle is fittingly held against the bottom of the molten metal pouring device.

10 Claims, 9 Drawing Figures

15
II
25
16
17
18
19
20
26
29
28
10
6
40
4
41
12
9
11
27
IV
31
32
33
36
30
1
L
5
35
3
III 17
18
19
20
7
41
4
40
11
46
45
13
5
10
3

APPARATUS FOR COMPRESSIVELY HOLDING CASTING NOZZLES

BACKGROUND OF THE INVENTION (a) Field of the Invention

The present invention relates to an apparatus for exchanging a so called casting nozzle and compressively holding an exchanged casting nozzle against a device for controlling the rate of flow of molten metal such as a teeming nozzle or a sliding nozzle plate. The casting nozzle may be an immersion nozzle, a long nozzle that is provided at the bottom of a molten metal container or a refractory member of a sliding nozzle apparatus employed for preventing metal from oxidation and trapping-in of non-metallic inclusions.

(b) Description of the Prior Art

Casting nozzles are required to be frequently changed or replaced with new ones since they are held in direct contact with the flowing molten metal and hence tend to be melted, broken, or otherwise damaged. The casting nozzles should be replaced in a short period of time so as not to increase the downtime. The replacing process is burdensome on the worker since it has to be carried out at high temperature.

When connecting the casting nozzle to the base of a nozzle device, e.g., when coupling an immersion nozzle to the lower nozzle of a sliding nozzle device, a certain pressure must be applied to the nozzle in order to prevent the molten metal from leaking or air from entering the molten metal.

One conventional casting nozzle changer designed to meet the above requirements is disclosed in Japanese Utility Model Publication No. 58-4907. The disclosed nozzle changing apparatus includes an attachment fixed to a slide table holder and having rail grooves and a lower nozzle receiver having horizontal projections fitted slidably in the rail grooves. Two lower nozzles are horizontally slidable through the above interfitting mechanism. One of the lower nozzles is held in intimate fitting contact with the slide table of the sliding nozzle device by means of a wedge-shaped cotter wedged between the rail groove and the projection fitted therein, and the other lower nozzle is freely suspended from the attachment, there being a cotter removing plate between the lower nozzles. The old lower nozzle can be replaced with the new lower nozzle by pushing the new lower nozzle with a piston.

In the conventional practice for changing the lower nozzles, the cotter removing plate is required to be inserted from behind since the lower nozzle should be held in intimate fitting contact with the sliding nozzle slide table when wedging the wedge-shaped cotter with the new lower nozzle held in the fitting position. Therefore, manual labor is needed in a high-temperature environment, using auxiliary tools in wedging the wedge-shaped cotter or attaching and detaching the cotter removing plate.

It has been difficult to adjust or establish the required amount of forces to compressively hold the lower nozzle only with the cotter having a fixed thickness. Consequently, the lower nozzle has not been held in intimate fitting contact with the slide table under an appropriate pressure, and a long period of time has been needed for the operation.

SUMMARY OF THE INVENTION

It is an object of the present invention to provide an apparatus for compressively holding a casting nozzle in intimate fitting contact with a refractory plate or a teeming nozzle for completely preventing the molten metal from leaking and also preventing air from entering the molten metal, so that casting nozzles can easily and reliably be changed.

Another object of the present invention is to provide an apparatus for changing casting nozzles quickly and automatically.

According to the present invention, there is provided an apparatus for compressively holding a casting nozzle against a teeming nozzle on a molten metal container or a lower refractory member of a device for controlling the rate of flow of molten metal, the apparatus including a device for pouring molten metal; a holder frame fixed to the bottom of the pouring device and defining a casting nozzle travel passageway; a compressive holder disposed in the casting nozzle travel passageway for holding the casting nozzle under compression; a spring box mounted on the holder frame across the compressive holder and having outer side portions resiliently supported by springs on opposite sides of the holder frame across the casting nozzle travel passageway, the spring box having on inner sides thereof guide rails forming part of side portions of the casting nozzle travel passageway; a nozzle moving mechainsm mounted on the holder frame for moving the casting nozzle along the guide rails; and a lifting mechanism for lifting the casting nozzle in unison with the spring box in response to movement of the casting nozzle along the guide rails until the casting nozzle is fittingly held against the teeming nozzle or the refractory member.

The casting nozzle can be pressed against the teeming nozzle or the refractory member under suitable pressure in the compressive holder when it replaces an old casting nozzle.

According to the present invention, there is also provided an apparatus for changing casting nozzles, including a device for pouring molten metal; a holder frame fixed to the bottom of the pouring device and defining a substantially C-shaped casting nozzle travel passageway composed of a new-nozzle insertion passage, an old-nozzle ejection passage extending parallel thereto in spaced-apart relationship, and a joint passage connecting the new-nozzle insertion passage and the old-nozzle ejection passage to each other; a compressive holder disposed in the joint passage for holding the casting nozzle under compression; a first nozzle pusher mounted on the frame holder for pushing a new casting nozzle inserted in the new-nozzle insertion passage toward the compressive holder along the joint passage; and a second nozzle pusher mounted on the frame holder for pushing an old casting nozzle out of the old-nozzle ejection passage.

The old casting nozzle can easily be replaced with the new casting nozzle quickly and automatically in the C-shaped nozzle travel passageway.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
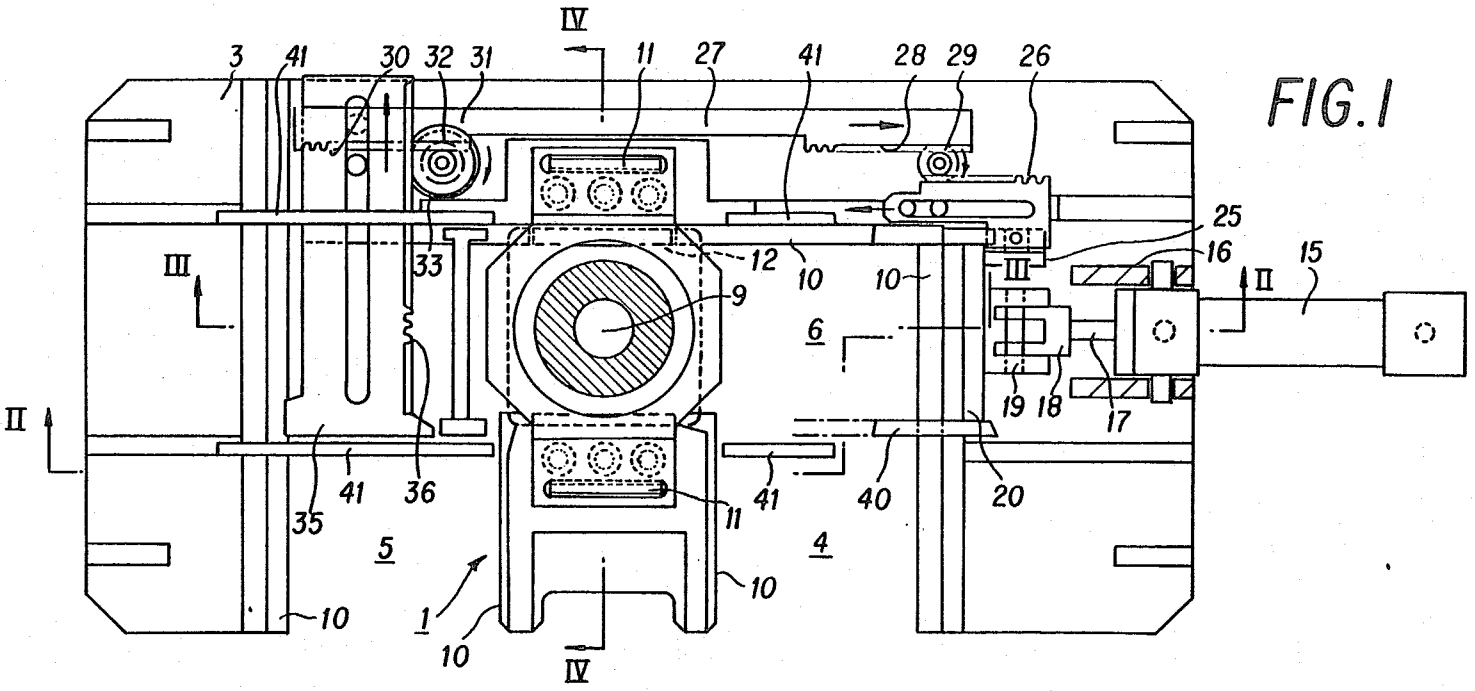
FIG. 1 is a plan view of an apparatus for changing casting nozzles according to the present invention.

As shown in FIG. 1, an apparatus for changing casting nozzles according to the present invention includes a sliding nozzle device 1 having a three-plate construction (FIG. 3) and fixed to the bottom of a container 2 for containing a molten metal.

A holder frame 3 has a new-nozzle insertion passage 4 extending from one side of the apparatus in a direction normal to the longitudinal axis of the holder frame 3, an old-nozzle ejection passage 5 spaced a distance L from said one side of the apparatus and extending parallel to the new-nozzle insertion passage 4, and a casting-nozzle travel passage 6 joining the ends of the passages 4, 5 and extending along the longitudinal axis of the holder frame 3. The passages 4, 5, 6 jointly define a substantialy C-shaped nozzle travel space or passageway.

A casting position 9 is disposed in the casting-nozzle travel passage 6 which is the position for connecting an immersion nozzle 7 (shown in FIG. 3) to a lower nozzle 8 of the sliding nozzle device 1.

A guide rail 10 is mounted on the holder frame 3 along the C-shaped nozzle travel space. An immersion nozzle holder 23 (described later) is slidably supported on the guide rail 10.

On the holder frame 3, there is mounted a spring box 11 for pressing the immersion nozzle 7 against the lower nozzle 8. The spring box 11 has on its inner sides thereof guide rails 12 for slidably receiving the immersion nozzle holder 23 from the guide rail 10 and supporting the immersion nozzle holder 23.

Figure 4:
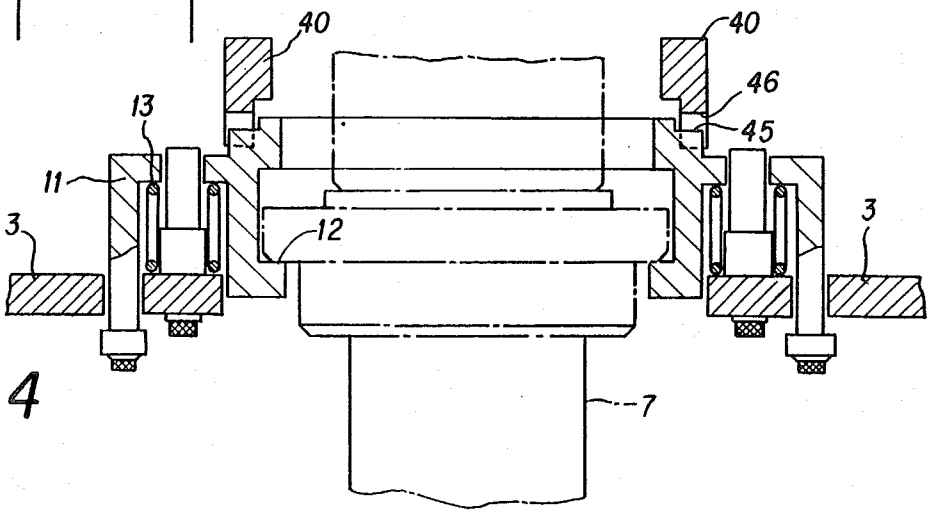
FIG. 4 is a cross-sectional view taken along line IV—IV of FIG. 1.

As illustrated in FIG. 4, the spring box 11 houses springs 13 for normally urging the spring box 11 in a direction toward the sliding nozzle device 1.

Figure 2:
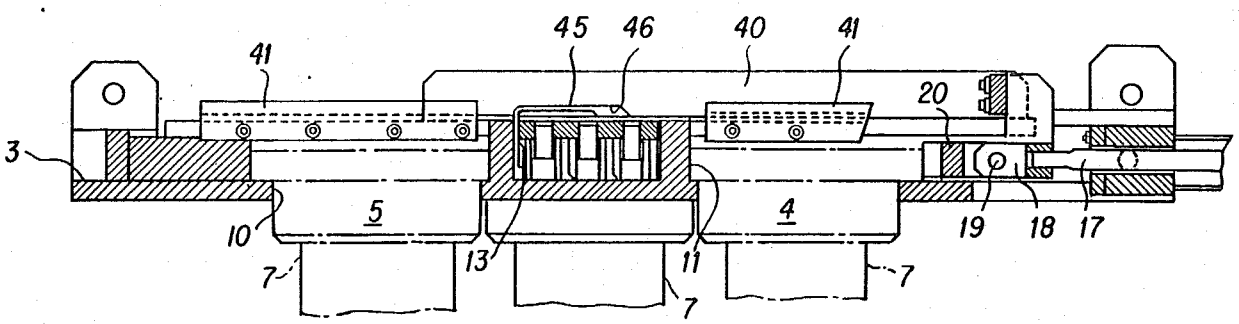
FIG. 2 is a cross-sectional view taken along line II—II of FIG. 1.

As shown in FIGS. 1 and 2, a fluid cylinder 15 is mounted on one side of the holder frame 3 and supported thereon by a support member 16 fixed to the holder frame 3. The fluid cylinder 15 has a rod 17 to which a forked end 18 is bolted. The forked end 18 is coupled by a pin 19 to a first nozzle pusher 20.

As illustrated in FIG. 1, the first nozzle pusher 20 comprises a plate having substantially the same width as that of the joint passage 6. The first nozzle pusher 20 is movable longitudinally into and out of the joint passage 6 as the rod 17 is extended and retracted for moving the immersion nozzle 7 in the joint passage 6.

A rack driver 25 is fixed to one end of the first nozzle pusher 20. To the rack driver 25, there is connected a rack 26 movable in unison with the first nozzle pusher 20 in one direction.

In FIG. 1, a connector plate 27 is mounted on the holder frame 3 for longitudinal movement along the joint passage 6, the connector plate 27 having substantially the same length as that of the joint passage 6. The connector plate 27 has on one end thereof a rack 28 held in mesh with a pinion 29 which meshes with the rack 26, so that the connector plate 27 is movable back and forth by the rack 26.

Instead of using the rack 26 and the pinion 29, another arrangement can be employed so that the rack 28 may be driven directly by the rack driver 25.

The connector plate 27 has on the other end a rack 30 held in mesh with a multigear pinion 31 mounted on the holder frame 3. The multigear pinion 31 includes a smaller-diameter gear 32 meshing with the rack 30 and a larger-diameter gear 33 integral with the smaller-diameter gear 32 in coaxial relation thereto. The connector plate 27 may be dispensed with, and the smaller-diameter gear 32 may be operatively coupled by a chain to the pinion 29 for being driven thereby.

As shown in FIG. 1, a second nozzle pusher 35 is disposed in the holder frame 3 for moving the immersion nozzle in a direction along the axis of the nozzle ejection passage 5, i.e., normal to the axis of the joint passage 6. The second nozzle pusher 35 has on one side thereof a rack 36 meshing with the larger-diameter gear 33 of the multigear pinion 31.

As shown in FIG. 2, the spring box 11 has raised portions 45 on its upper end, and a pair of spring box lowering levers 40 connected to the pusher 20 have recesses 46 in lower edges thereof.

When the rod 17 of the fluid cylinder 15 remains retracted, the raised portions 45 are positioned in the recesses 46 of the spring box lowering levers 40, and the spring box lowering levers 40 are not in interference with the spring box 11.

When the fluid cylinder 15 is actuated to extend the rod 17 from the retracted portion into the casting-nozzle travel passage 6, the bottom surfaces of the spring box lowering levers 40 depress the raised portions 45 of the ing box 11, which is lowered as a whole while compressing the springs 13.

As shown in FIGS. 1 and 2, the spring box lowering levers 40 have one end fixed by bolts to the upper end of the first nozzle pusher 20. The levers 40 are employed for lifting and lowering the spring box 11 in response to back-and-forth movement of the first nozzle pusher 20. Upon actuation of the fluid cylinder 15, the spring box lowering levers 40 are moved along the opposite surfaces of the joint passage 6 while being guided by guide plates 41, respectively.

As the fluid cylinder 15 is driven, the first nozzle pusher 20 is moved back and forth in the joint passage 6, and at the same time the second nozzle pusher 35 is moved back and forth in the old-nozzle ejection passage 5 at an increased rate. The first and second nozzle pushers 20, 35 are operatively coupled by the rack-and-pinion mechanism such that when the first nozzle pusher 20 is moved into the passage 6, the second nozzle pusher 35 is retracted, and vice versa.

With the rod 17 of the fluid cylinder 15 being retracted, the raised portions 45 of the spring box 11 are positioned respectively in the recesses 46 of the spring box lowering levers 40, which are not in interference with the spring box 11.

When the rod 17 is moved from the retracted position into the joint passage 6 upon actuation of the fluid cylinder 15, the bottom surfaces of the spring box lowering levers 40 depress the raised portions 45 of the spring box 45 to lower the spring box 45 bodily while compressing the springs 13, as described above. When the rod 17 is moved back to the retracted position by the fluid cylinder 15, the spring box 11 is caused to be lifted under the forces of the springs 13.

The old-nozzle ejection passage 5 may be positioned on a straight extension of the joint passage 6, or on one side of the joint passage 6 which is opposite to that shown in FIG. 1.

Figure 3:
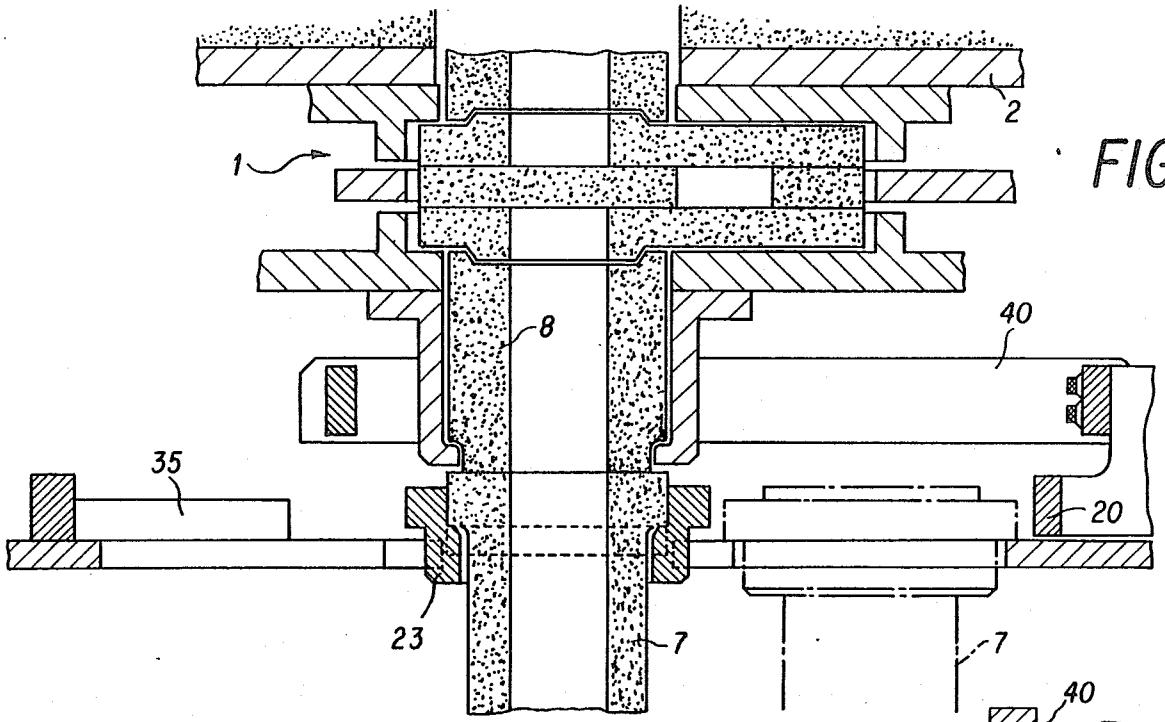
FIG. 3 is a cross-sectional view taken along line III—III of FIG. 1.

Operation of the nozzle changing apparatus thus constructed for changing casting nozzles will be described with reference to FIGS. 5 through 8. At first, the sliding nozzle device 1 above the immersion nozzle 7 is closed as shown in FIG. 3, and the rod 17 of the fluid cylinder 15 is retracted as illustrated in FIG. 5.

Figure 5:
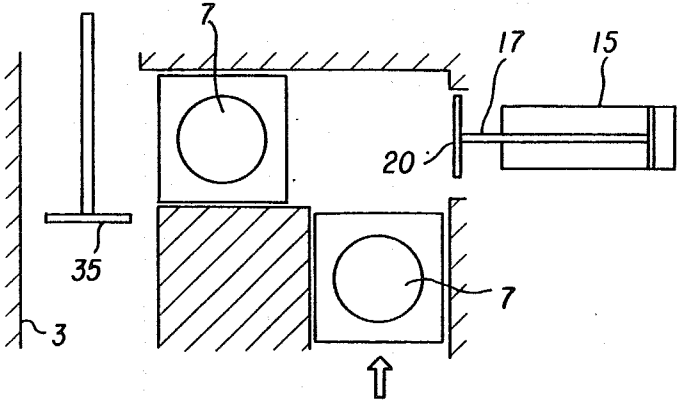
Figure 6:
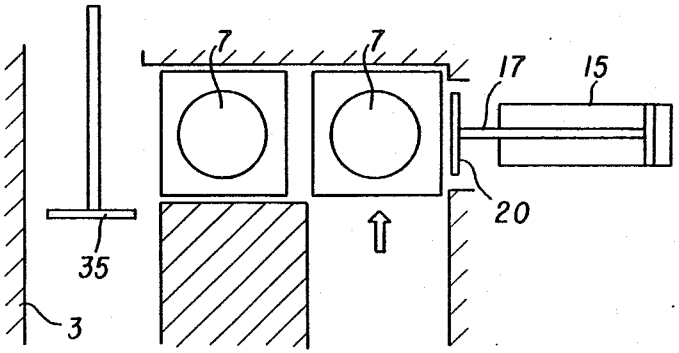

Then, as shown in FIG. 5, a new immersion nozzle 7 is placed on the guide rail 10 in the new-nozzle insertion passage 4, and, as shown in FIG. 6, the immersion nozzle 7 is pushed by a suitable means along the new-nozzle insertion passage 4 into a position in front of the first nozzle pusher 20.

Figure 7:
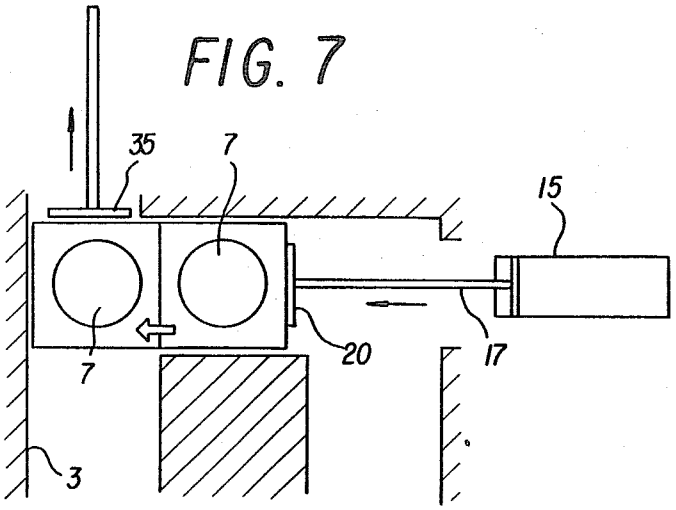
FIGS. 5 through 8 are fragmentary views explanating a nozzle changing operation effected by the apparatus of FIG. 1.
Figure 8:
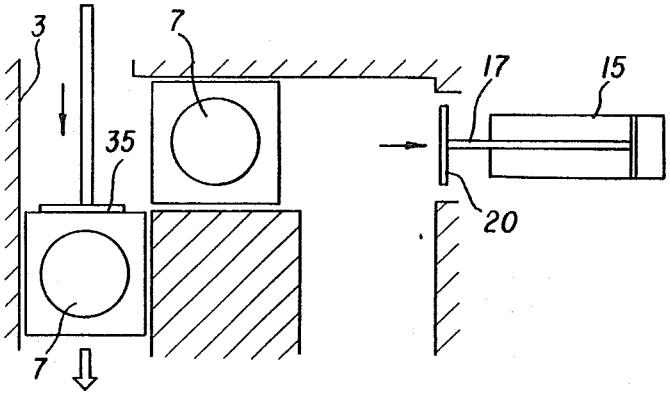

The fluid cylinder 15 is now actuated to move the first nozzle pusher 20 to advance the immersion nozzle 7 to the casting position 9 as shown in FIG. 7. Upon movement of the first nozzle pusher 20, the spring box lowering levers 40 are also moved in a forward direction to lower the spring box 11 bodily. The movement of the first nozzle pusher 20 is transmitted by the rack-and-pinion mechanism to the second nozzle pusher 35 which is completely retracted out of the old-nozzle ejection passage 5. The old immersion nozzle 7 is pushed by the new immersion nozzle 7 into a position in front of the second nozzle pusher 35.

Thereafter, the fluid cylinder 15 is actuated to retract the first nozzle pusher 20 out of the passage 6, and also to move the second nozzle pusher 35 toward the outlet of the old-nozzle ejection passage 5 until the old-immersion nozzle 7 is moved out of the passage 5. As the raised portions 45 of the spring box 11 enter the recesses 46 of the spring box lowering lever 40, the spring box 11 is raised by the springs 13 to lift the flange of the immersion nozzle holder 23 on the guide rails 12 of the spring box 11 until the new immersion nozzle 7 is pressed against the lower nozzle 8.

Figure 9:
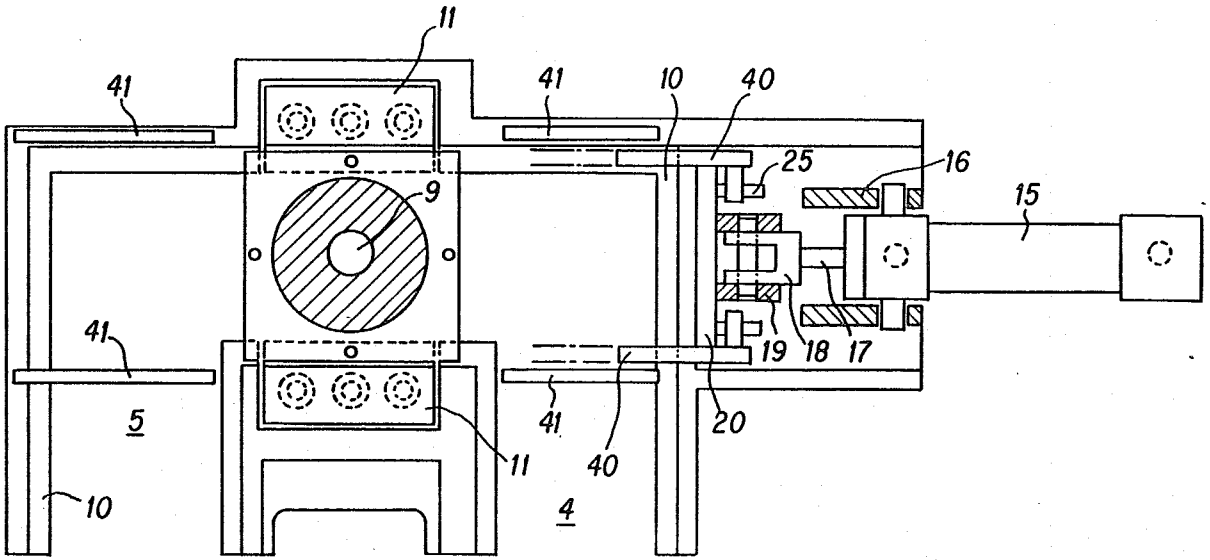
FIG. 9 is a plan view of an apparatus for changing casting nozzles according to another embodiment of the present invention.

FIG. 9 shows an apparatus for changing casting nozzles according to another embodiment of the present invention. Those parts in FIG. 9 which are identical to those in FIG. 1 are denoted by identical reference numerals.

As shown in FIG. 9, the apparatus has no second nozzle pusher and no rack-and-pinion mechanism for ejecting the old casting nozzle, which can instead be ejected manually or by another mechanism.

The apparatus shown in FIG. 9 has a casting position 9 where there is compressive holding of a casting nozzle against the receiver nozzle of a molten metal container under suitable pressure when casting nozzles are exchanged.

In the above embodiments, the immersion nozzle is shown as the casting nozzle and connected to the lower plate of the sliding nozzle device through the lower nozzle. However, the present invention is not limited to the illustrated arrangement. The invention is applicable to an arrangement for connecting a casting nozzle directly to the lower plate of a sliding nozzle device or for pressing a casting nozzle directly against the lower portion of a teeming nozzle, without using the sliding nozzle device. In such a modification, the lower portion of the teeming nozzle should be elongated or an auxiliary nozzle should be attached to the teeming nozzle to allow the casting nozzle to be coupled to the teeming nozzle.

Although certain preferred embodiments have been shown and described, it should be understood that many changes and modifications may be made therein without departing from the scope of the appended claims.

What is claimed is:

1. An apparatus for holding a casting nozzle against a device for controlling the rate of flow of molten metal comprising, a holder frame fixed to the bottom of said device and defining a casting nozzle travel passageway, a compressive holder disposed in said casting nozzle travel passageway for holding the casting nozzle, a spring box means on said holder having outer side portions resiliently supported by springs on opposite sides of said holder frame and rigidly connected to inner side portions provided with guide rail means forming a part of said passageway located beneath said device, a nozzle moving means mounted on said holder frame for moving the casting nozzle along said guide rail means, and a lifting means for causing the lifting of the casting nozzle against said device by said spring box means in response to movement of the casting nozzle along said guide rail means to fittingly hold said casting nozzle against said device.

2. An apparatus for holding a casting nozzle means against a device for controlling the rate of flow of molten metal comprising a holder frame on said device, casting nozzle travel passageway means on said holder frame providing a passageway for said casting nozzle means, a nozzle moving mechanism mounted on said holder frame for moving said casting nozzle along at least portions of said passageway means, said passageway means having a casting position in which said casting nozzle means underlies said device for receiving said molten metal from said device, a spring box means mounted on said holder frame at said casting position, said spring box means having spring box guide rails which form part of said passageway means such that said nozzle moving mechanism is operable to move casting nozzle means along said passageway means to said casting position where said spring box guide rails engage said casting nozzle means, and lifting actuating means operably disposed between said spring box means and said nozzle moving mechanism for actuating said spring box means so that the latter biasingly urges said casting nozzle means against said device when said nozzle moving mechanism moves said casting nozzle means to said casting position.

3. An apparatus according to claim 2, wherein said passageway means comprises passageway guide rails for supporting said casting nozzle means as the latter is moved by said nozzle moving mechanism, said passageway guide means leading to and from said casting position, said spring box guide rails forming a continuation of said passageway guide rails.

4. An apparatus according to claim 2, wherein said spring box means comprises a plurality of springs for biasingly urging said casting nozzle means against said device.

5. An apparatus according to claim 4, wherein said lifting actuating means comprises spring box levers on said nozzle moving mechanism having a lower edge with a recess in said lower edge, said spring box means having a raised portion, said lower edge engaging said raised portion to dispose said spring box guide rails at one elevation when said nozzle moving mechanism is moving said casting nozzle means toward said casting position, said raised portion being disposed in said recess when said casting nozzle means is in said casting position such that said springs bodily lift said spring box guide rails and said casting nozzle means to a higher elevation where said casting nozzle means is biasingly disposed against said device.

6. An apparatus according to claim 2, wherein said passageway means comprises an insertion passage, an ejection passage and a travel passage extending between said insertion passage and said ejection passage.

7. An apparatus according to claim 6, wherein said insertion passage and said ejection passage are perpendicular to said travel passage.

8. An apparatus according to claim 6, wherein said nozzle moving mechanism comprises power operable means for moving said casting nozzle means along said travel passage.

9. An apparatus according to claim 8, wherein said nozzle moving mechanism further comprises ejection means operable by said power operable means for moving said casting nozzle means along said ejection passage.

10. An apparatus according to claim 9, wherein said power operable means comprises a first elongated rack driving a first gear, said ejection means comprises a second gear driven by said first gear and driving a second elongated rack, said first rack being parallel to said travel passage, said second rack being parallel to said ejection passage, said first and second gears being coaxially disposed.

* * * * *